US011247755B2

(12) United States Patent
Schuyler

(10) Patent No.: US 11,247,755 B2
(45) Date of Patent: Feb. 15, 2022

(54) INFLATABLE DEVICE AND METHOD OF INFLATING SAME

(71) Applicant: SPIN MASTER, INC., Williamsville, NY (US)

(72) Inventor: Robert Schuyler, Toronto (CA)

(73) Assignee: SPIN MASTER, INC., Williamsville, NY (US)

( * ) Notice: Subject to any disclaimer, the term of this patent is extended or adjusted under 35 U.S.C. 154(b) by 0 days.

(21) Appl. No.: 16/883,779

(22) Filed: May 26, 2020

(65) Prior Publication Data

US 2020/0369353 A1 Nov. 26, 2020

Related U.S. Application Data

(60) Provisional application No. 62/852,566, filed on May 24, 2019.

(51) Int. Cl.
*B63C 9/00* (2006.01)
*B63C 9/08* (2006.01)

(52) U.S. Cl.
CPC . *B63C 9/00* (2013.01); *B63C 9/08* (2013.01)

(58) Field of Classification Search
CPC ... B63C 9/00; B63C 9/08; F04B 45/00; F04B 45/04; F04B 33/00
USPC ..... 441/129, 131, 136
See application file for complete search history.

(56) References Cited

U.S. PATENT DOCUMENTS

2017/0225872 A1 8/2017 Collie
2017/0292511 A1* 10/2017 Frayne ..... F04B 45/06

FOREIGN PATENT DOCUMENTS

CN 204937424 U 1/2016
CN 108750041 A 11/2018

OTHER PUBLICATIONS https://www.kickstarter.com/projects/jens-plus/the-fluxbag-inflates-anything-with-just-one-breath/description—2016.

* cited by examiner

*Primary Examiner* — Lars A Olson
(74) *Attorney, Agent, or Firm* — Millman IP Inc.

(57) ABSTRACT

An inflatable device is provided, and contains a body and a mouth. The mouth is positionable in an open position and a sealed position. The body includes a flexible body wall that defines an interior volume. The body defines at least one air flow path from the mouth through the interior volume. The air flow path has an air flow path axis and has a cross-sectional area. The body further includes at least one structural member that applies a force on the flexible body wall transversely outward from the axis so as to urge the flexible body wall towards a transversely expanded state. The body is movable between an axially collapsed state and an axially open state along at least a portion of the air flow path and is urged towards the axially expanded state by a force applied by at least one of: the at least one structural member, and air flow into the body through the mouth when the mouth is held in the open position.

18 Claims, 6 Drawing Sheets

INFLATABLE DEVICE AND METHOD OF INFLATING SAME

CROSS-REFERENCE TO RELATED APPLICATION

This application claims the benefit of US Provisional application No. 62/852,566 filed May 24, 2019, the content of which is incorporated herein by reference in its entirety.

FIELD

The specification relates generally to inflatable devices.

BACKGROUND OF THE DISCLOSURE

Inflatable devices such as pool floats can be handy and fun to use at a pool, at the beach, while camping, or in a multitude of other places. However, inflating an inflatable device can be time consuming. Improved inflatable devices which are easy to inflate quickly, while remaining lightweight and compact would be beneficial.

SUMMARY OF THE DISCLOSURE

The present disclosure provides an inflatable (also referred to as an inflatable device) as described herein.

In some embodiments, the present disclosure provides an inflatable comprising: a sealed distal end; a proximal end; a mouth having an open position and a closed position; an inflatable length extending from the sealed distal end to the proximal end; an inflatable interior comprising an interior volume in gaseous communication with the mouth when the mouth is in the open position, a sealed flexible body wall extending from the closed distal end to the proximal end; a structural distal ring connected to the sealed flexible body wall and located between the proximal end and the sealed distal end; a structural proximal ring connected to the sealed flexible body wall and located proximal relative to the structural distal ring and between the proximal end and the sealed distal end. Optionally, the inflatable comprises a collapsed state in which the inflatable has a collapsed length and in which the structural proximal ring is located a first distance proximal relative to the structural distal ring. Optionally, the inflatable comprises an expanded state in which the inflatable has an expanded length and in which the structural proximal ring is located a second distance proximal relative to the structural distal ring, the expanded length greater than the collapsed length and the second distance greater than the first distance. Optionally, the interior volume is sealed when the mouth is in the closed position.

Optionally, the structural proximal ring is generally parallel to the structural distal ring. Optionally, the structural distal ring and structural proximal ring are located in the inflatable interior. Optionally, the mouth is adjacent to the proximal end.

Optionally, the inflatable is in generally tubular in shape when the inflatable is in the expanded state. Optionally, the inflatable is in generally cylindrical in shape when the inflatable is in the expanded state. Optionally, the structural distal ring and structural proximal ring each comprise a diameter generally perpendicular to the inflatable length. Optionally, the diameters of the structural distal ring and the structural proximal ring are substantially equal in size. Optionally, the inflatable further comprises a structural middle ring located between the structural proximal ring and the structural distal ring and attached to the sealed flexible body wall. Optionally, the proximal end further comprises a strap adjacent to the mouth, the strap configured to secure the mouth in the closed position. Optionally, the inflatable comprises an inflatable diameter generally perpendicular to the inflatable length, the inflatable diameter less than the inflatable length when the inflatable is in the expanded state. Optionally, the inflatable is generally tubular and is connected to a second tubular inflatable by a mesh bridge to form a pool float. Optionally, the pool float is in the form of a hammock. Optionally, the mouth comprises substantially the entire surface area of the proximal end.

The present disclosure also provides a method of inflating an inflatable comprising the steps of: a) providing the inflatable wherein the inflatable is in the collapsed state and the mouth is in the open position; b) moving air through the mouth and into the interior volume to move the inflatable into the expanded state; c) rolling the proximal end in the distal direction to move the mouth to the closed position; and optionally d) securing the mouth in the closed position and the inflatable in the rolled up position (and expanded state) using the strap.

The present disclosure also provides an inflatable comprising: a sealed distal end; a proximal end; a mouth having an open position and a closed position; an inflatable length extending from the sealed distal end to the proximal end; an inflatable interior comprising an interior volume in gaseous communication with the mouth when the mouth is in the open position, a sealed flexible body wall extending from the closed distal end to the proximal end; a structural distal rib connected to the sealed flexible body wall and located between the proximal end and the sealed distal end; a structural proximal rib connected to the sealed flexible body wall and located proximal relative to the structural distal rib and between the proximal end and the sealed distal end. Optionally, the inflatable comprises a collapsed state in which the inflatable has a collapsed length and in which the structural proximal rib is located a first distance proximal relative to the structural distal rib. Optionally, the inflatable comprises an expanded state in which the inflatable has an expanded length and in which the structural proximal rib is located a second distance proximal relative to the structural distal rib, the expanded length greater than the collapsed length and the second distance greater than the first distance. Optionally, the interior volume is sealed when the mouth is in the closed position.

Optionally, the structural proximal rib is generally parallel to the structural distal rib. Optionally, the structural proximal rib and structural distal rib form a substantially closed perimeter around the interior volume and further wherein the ribs comprise a hollow interior. Optionally, the structural proximal rib and structural distal rib are located in the inflatable interior. Optionally, the mouth is adjacent to the proximal end. Optionally, the inflatable is in generally tubular in shape when the inflatable is in the expanded state. Optionally, the inflatable is in generally cylindrical in shape when the inflatable is in the expanded state. Optionally, the structural proximal rib and structural distal rib each comprise a diameter generally perpendicular to the inflatable length. Optionally, the diameters of the structural proximal rib and structural distal rib are substantially equal in size. Optionally, the inflatable further comprises a structural middle rib located between the structural proximal rib and the structural distal rib and attached to the sealed flexible body wall. Optionally, the proximal end further comprises a strap adjacent to the mouth, the strap configured to secure the mouth in the closed position. Optionally, the inflatable comprises an inflatable diameter generally perpendicular to the inflatable length, the inflatable diameter less than the inflatable length when the inflatable is in the expanded state. Optionally, the inflatable is generally tubular and is connected to a second tubular inflatable by a mesh bridge to form a pool float. Optionally, the pool float is in the form of a hammock. Optionally, the mouth comprises substantially the entire surface area of the proximal end.

The present disclosure also provides a method of inflating an inflatable comprising the steps of: a) providing the inflatable wherein the inflatable is in the collapsed state and the mouth is in the open position; b) moving air through the mouth and into the interior volume to move the inflatable into the expanded state; c) rolling the proximal end in the distalward direction to move the mouth to the closed position; and optionally d) securing the mouth in the closed position and the inflatable in the rolled up position (and expanded state) using the strap.

In another aspect, the present disclosure relates to an inflatable device, which includes a body and a mouth. The mouth is positionable in an open position and a sealed position. The body includes from a flexible body wall that defines an interior volume, and defines at least one air flow path from the mouth through the interior volume, the air flow path having an air flow path axis and having a cross-sectional area. The body further includes at least one structural member that applies a force on the flexible body wall transversely outward from the axis so as to urge the flexible body wall towards a transversely expanded state. The body is movable between an axially collapsed state and an axially open state along at least a portion of the air flow path and is urged towards the axially expanded state by a force applied by at least one of: the at least one structural member, and air flow into the body through the mouth when the mouth is held in the open position.

In yet another aspect, an inflatable device is provided, and includes a mouth, a body, a structural distal ring and a structural proximal ring. The mouth has an open position and a sealed position. The body has a distal end that is closed, and a proximal end. The body defines an interior volume in gaseous communication with the mouth when the mouth is in the open position. The body has a flexible body wall extending from the distal end to the proximal end. The flexible body wall is air impermeable. The structural distal ring is more rigid than the flexible body wall, and is connected to the flexible body wall, and is positioned between the proximal end and the sealed distal end. The structural proximal ring is more rigid than the flexible body wall, and is connected to the flexible body wall, and is positioned between the proximal end and the sealed distal end, and is proximal relative to the structural distal ring. The body is collapsible to a collapsed state in which the body has a collapsed length and in which the structural proximal ring is located a first distance from the structural distal ring. The body is inflatable to an expanded state in which the body has an expanded length and in which the structural proximal ring is located a second distance from the structural distal ring. The expanded length is greater than the collapsed length, and the second distance is greater than the first distance. The interior volume is sealed when the mouth is in the sealed position.

BRIEF DESCRIPTIONS OF THE DRAWINGS

For a better understanding of the various embodiments described herein and to show more clearly how they may be carried into effect, reference will now be made, by way of example only, to the accompanying drawings in which.

DETAILED DESCRIPTION

Figure 1A:
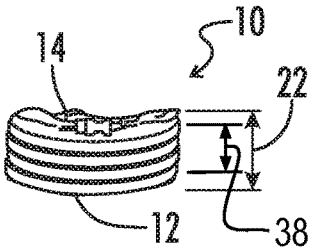
FIG. 1A illustrates a perspective view of an inflatable device in accordance with an embodiment of the present disclosure, having a body and a mouth, with the mouth in an open position, while the body is in a collapsed state.

For simplicity and clarity of illustration, where considered appropriate, reference numerals may be repeated among the Figures to indicate corresponding or analogous elements. In addition, numerous specific details are set forth in order to provide a thorough understanding of the embodiments described herein. However, it will be understood by those of ordinary skill in the art that the embodiments described herein may be practiced without these specific details. In other instances, well-known methods, procedures and components have not been described in detail so as not to obscure the embodiments described herein. Also, the description is not to be considered as limiting the scope of the embodiments described herein.

Various terms used throughout the present description may be read and understood as follows, unless the context indicates otherwise: "or" as used throughout is inclusive, as though written "and/or"; singular articles and pronouns as used throughout include their plural forms, and vice versa; similarly, gendered pronouns include their counterpart pronouns so that pronouns should not be understood as limiting anything described herein to use, implementation, performance, etc. by a single gender; "exemplary" should be understood as "illustrative" or "exemplifying" and not necessarily as "preferred" over other embodiments. Further definitions for terms may be set out herein; these may apply to prior and subsequent instances of those terms, as will be understood from a reading of the present description.

It will also be noted that the use of the term "a" or "an" will be understood to denote "at least one" in all instances unless explicitly stated otherwise or unless it would be understood to be obvious that it must mean "one".

With reference to FIGS. 1-8, the present disclosure provides an inflatable generally designed by the numeral 10. The inflatable 10 may also be referred to as an inflatable device 10. In the drawings, not all reference numbers are included in each drawing for the sake of clarity.

Referring further to FIGS. 1-8, the inflatable device 10 may include a body 11 having a sealed distal end 12; a proximal end 14; a mouth 16 having an open position 18 and a closed position 20; an inflatable length 22 extending from the sealed distal end 12 to the proximal end 14; an interior volume 26 defined by a flexible body wall 28 in gaseous communication with the mouth 16 when the mouth is in the open position, a flexible body wall 28 defining the interior volume 26 and extending from the closed distal end 12 to the proximal end 14. The body 11 defines an air flow path 29 from the mouth 16 through the interior volume 26. The air flow path 29 has an air flow path axis A and a cross-sectional area ACS, which may vary along the length of the air flow path 29.

The flexible body wall 28 is made from any suitable flexible material, such as vinyl. The flexible body wall 28 is air-impermeable, so that it holds air that is entrapped in the interior volume 26 thereof.

The body 11 further includes at least one structural member 30 that applies a force on the flexible body wall 28 transversely outward from the axis A so as to urge the flexible body wall 28 towards a transversely expanded state (shown in FIGS. 1C, 2, 3, 4, 7 and 8). The body 11 is movable between an axially collapsed state (FIGS. 1A and 1B) and an axially open state (FIGS. 1C, 2, 3, 4, 7 and 8) along at least a portion of the air flow path 29 and is urged towards the axially expanded state by a force applied by at least one of: the at least one structural member 30, and air flow into the body through the mouth 16 when the mouth 16 is held in the open position.

In the example embodiment shown, the at least one structural member includes a structural distal rib 31 and a structural proximal rib 32. The structural distal rib 31 is connected to the flexible body wall 28 and located between the proximal end 14 and the sealed distal end 12. The structural proximal rib 32 is connected to the flexible body wall 28 and located proximal relative to the structural distal rib 31 and between the proximal end 14 and the sealed distal end 12. The structural distal rib 31 and the structural proximal rib 32 are each more rigid than the flexible body wall 28, in order to urge the flexible body wall 28 towards the transversely expanded state.

Optionally, the inflatable device 10 comprises a collapsed state in which the inflatable device 10 has a collapsed length and in which the structural proximal rib 32 is located a first distance 38 proximal relative to the structural distal rib 31 and an expanded state in which the inflatable device 10 has an expanded length and in which the structural proximal rib 32 is located a second distance 44 proximal relative to the structural distal rib 31, the expanded length greater than the collapsed length and the second distance 44 greater than the first distance 38. The distal end 12 and wall 28 preferably are sealed meaning that air located in the interior volume 26 cannot leak out of the distal end and wall 28. Accordingly, the interior volume 26 is preferably, sealed when the mouth 16 is in the closed position 20. Preferably, the ribs 31 and 32 form a substantially closed perimeter shape around the interior volume 26, e.g., a closed circle with a hollow interior, the hollow interior forming part of the interior volume 26 (i.e., a ring as shown in FIGS. 1-8), a closed square with a hollow interior, the hollow interior forming part of the interior volume 26, or a closed oval with a hollow interior, the hollow interior forming part of the interior volume 26. For example, in the illustrated embodiments, the ribs 31 and 32 are in the form of rings. Without being bound by any particular theory, the ribs 31 and 32, which are preferably in the form of rings, ensure that the inflatable device 10 has some volume and some air is located in the interior volume 26 even when the inflatable device 10 is in the collapsed state. It will be understood that the collapsed state does not necessarily mean that the inflatable device 10 is fully deflated and likewise the expanded state does not mean that the inflatable is fully inflated; rather the terms "collapsed" and "expanded" are defined relative to each other—i.e., the inflatable length 22 is longer in the expanded state, and the distance between the ribs 31 and 32 is greater in the expanded state.

The ribs 31 and 32 preferably are relatively rigid whereas the wall 28 is preferably flexible, allowing the wall 28 (but not the ribs 31 and 32) to bend when the inflatable device 10 moves to the collapsed state. In some embodiments, the wall 28 is thinner than the ribs 31 and 32. The wall 28 and ribs 31 and 32 may be comprised of different materials—e.g., different types of plastic. In some embodiments, the ribs 31 and 32 may be made from ABS, for example. Alternatively, the ribs 31 and 32 may be made from a suitable metal such as aluminum or steel in the form of a band or wire.

In an embodiment, the ribs 31 and 32 are sewn into the flexible body wall 28 such that the ribs 31 and 32 are positioned in pockets in the flexible body wall 28.

Preferably, the mouth 16 is at the proximal end 14. Optionally, the inflatable device 10 is generally tubular in shape when the inflatable device 10 is in the expanded state, as shown in FIGS. 1-8. For example, the inflatable device 10 may be generally cylindrical in shape when the inflatable device 10 is in the expanded state, as shown in FIGS. 1-8, it being understood that cylindrical includes tapered cylinders.

Optionally, the structural distal rib 31 and structural proximal rib 32 each comprise a diameter 46 generally perpendicular to the inflatable length 22. Optionally, the diameters 46 of the structural distal rib 31 and the structural proximal rib 32 are substantially equal in size. Optionally, the inflatable device 10 further comprises one or more structural middle ribs 48 located between the structural proximal rib 32 and the structural distal rib 31 and attached to the sealed flexible body wall 28.

The mouth 16 includes a flexible mouth wall 64 that ends at a mouth opening 66. The mouth opening 66 is movable to a closed position by bringing a first portion 64*a* of the flexible mouth wall 64 into engagement with a second portion 64*b* of the flexible mouth wall 64 such that the mouth opening is shaped to have a first end 68 and a second end 70.

The mouth 16 may be placed in the closed position in any suitable way. For example, in the present embodiment, the mouth 16 includes a strap fastener 72 formed from a first strap fastener portion 72*a* on a first strap segment 52*a* extending from the first end 68 of the mouth opening 66 and a second strap fastener portion 72*b* on a second strap segment 52*b* extending from the second end 70 of the mouth opening 66.

Figure 3:
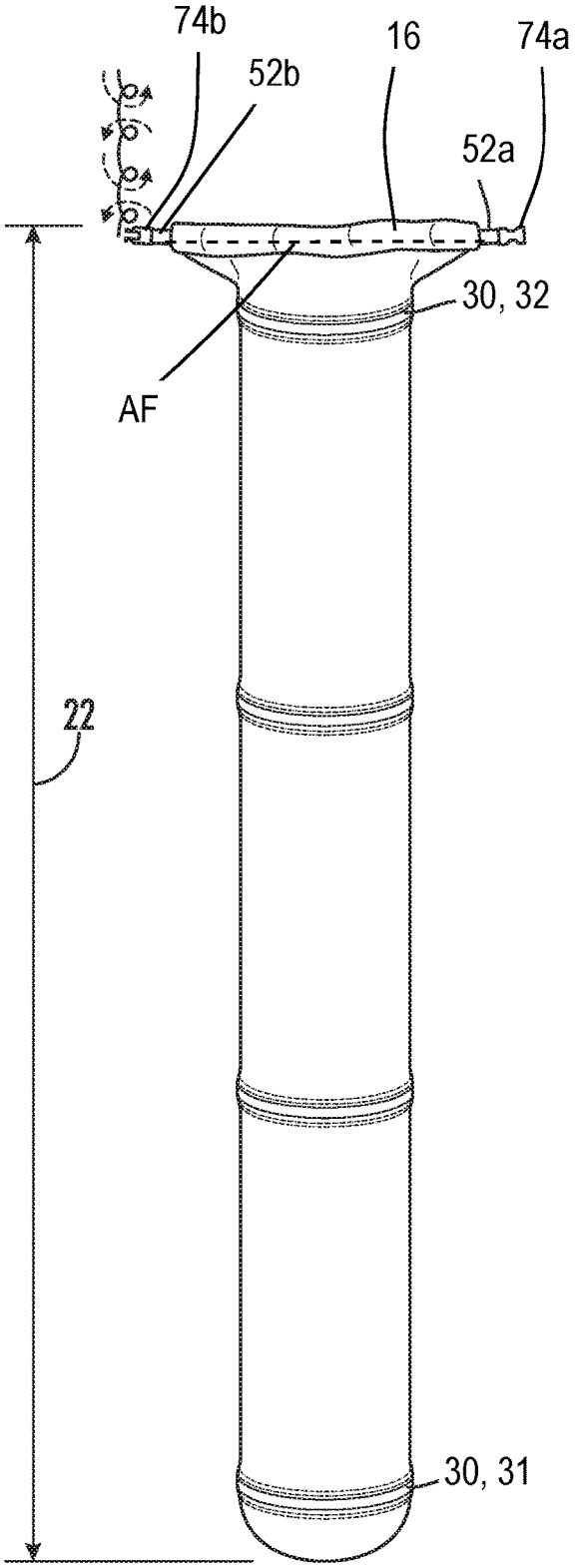
FIG. 3 illustrates a perspective view of the inflatable device of FIG. 1A after the user has begun to roll up the mouth, while the body is in the expanded state.

The first and second portions 64*a* and 64*b* of the flexible mouth wall 64 are foldable together iteratively a plurality of times about a folding axis AF that is parallel to a line (shown at LM) extending from the first end 68 of the mouth opening 66 to the second end 70 of the mouth opening 66, to bring the mouth 11 to a folded state as shown in FIG. 3. In the folded state, the first and second strap fastener portions 72*a* and 72*b* are connectable to one another to close the strap fastener 72 and thereby hold the mouth 11 in the folded state, which secures the mouth 16 in the closed position, sealing the mouth opening 66 against air leakage out therefrom, shown in FIG. 4.

In some embodiments, the first and second strap fastener portions 72*a* and 72*b* are first and second clip portions that clip together.

The first and second strap segments 52*a* and 52*b* may be portions of one strap shown at 52, which acts as a core about which the first and second portions 64*a* and 64*b* of the flexible mouth wall 64 are folded. Alternatively the first and second strap segments 52*a* and 52*b* may be completely separate from one another.

Optionally, the inflatable device 10 comprises an inflatable diameter 54 generally perpendicular to the inflatable length 22, the inflatable diameter 54 less than the inflatable length 22 when the inflatable device 10 is in the expanded state 40 (and preferably less than the inflatable length 22 when the inflatable is in the collapsed state 40).

Figure 7:
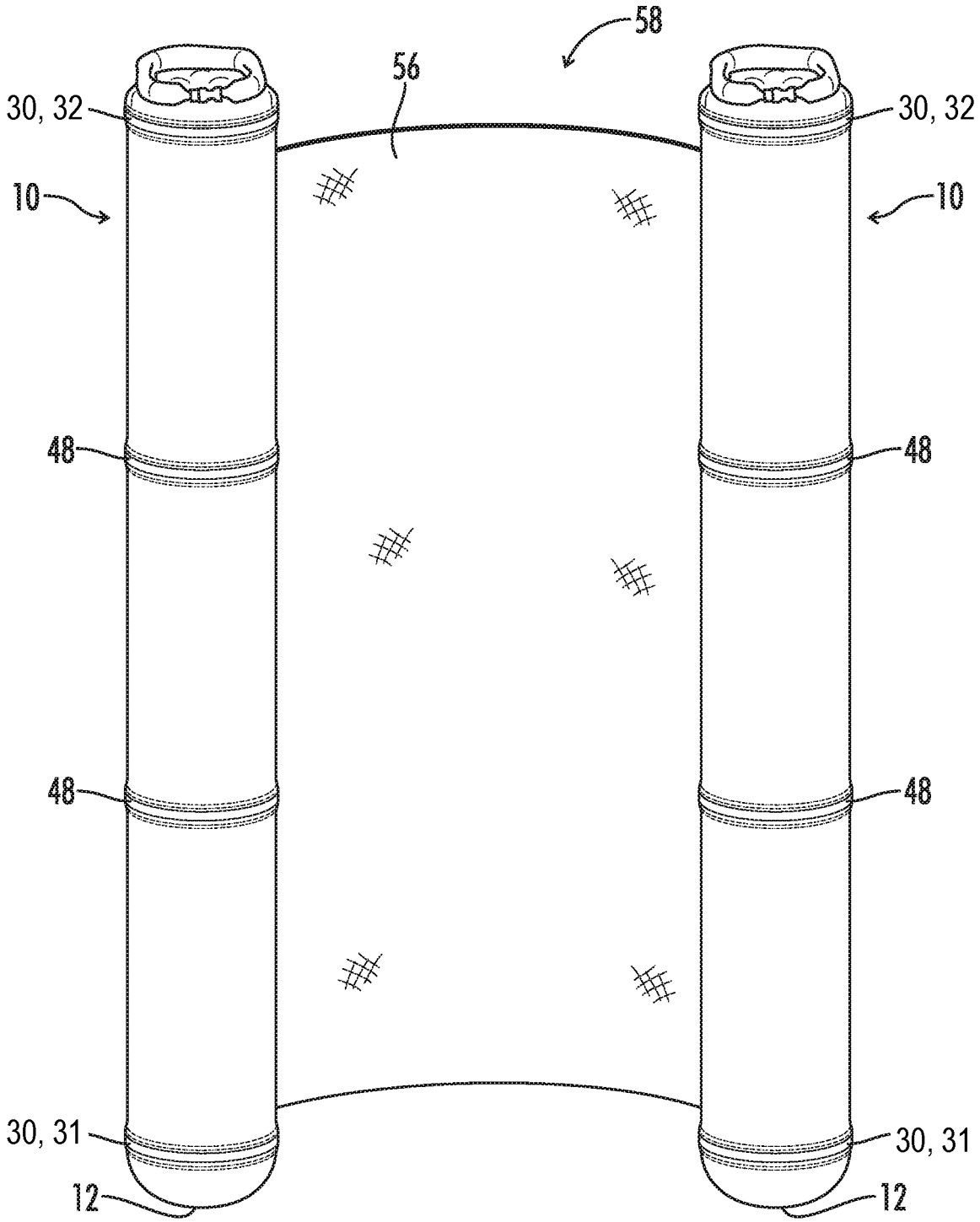
FIG. 7 illustrates a perspective view of a hammock pool float in accordance with another embodiment of the present disclosure, including two of the inflatable devices shown in FIG. 1A, joined by a mesh bridge, wherein the two inflatable devices having bodies in the expanded state.

Optionally the inflatable device 10 is generally tubular and is connected to a second tubular inflatable device 10 by a support sheet 56 formed from a mesh, thereby forming a pool float 58, as shown in FIG. 7. Optionally, as shown in FIG. 7, the pool float 58 is in the form of a hammock 60. Optionally, the mouth 16 comprises substantially the entire width (and optionally substantially the entire surface area) of the proximal end 14.

Figure 8:
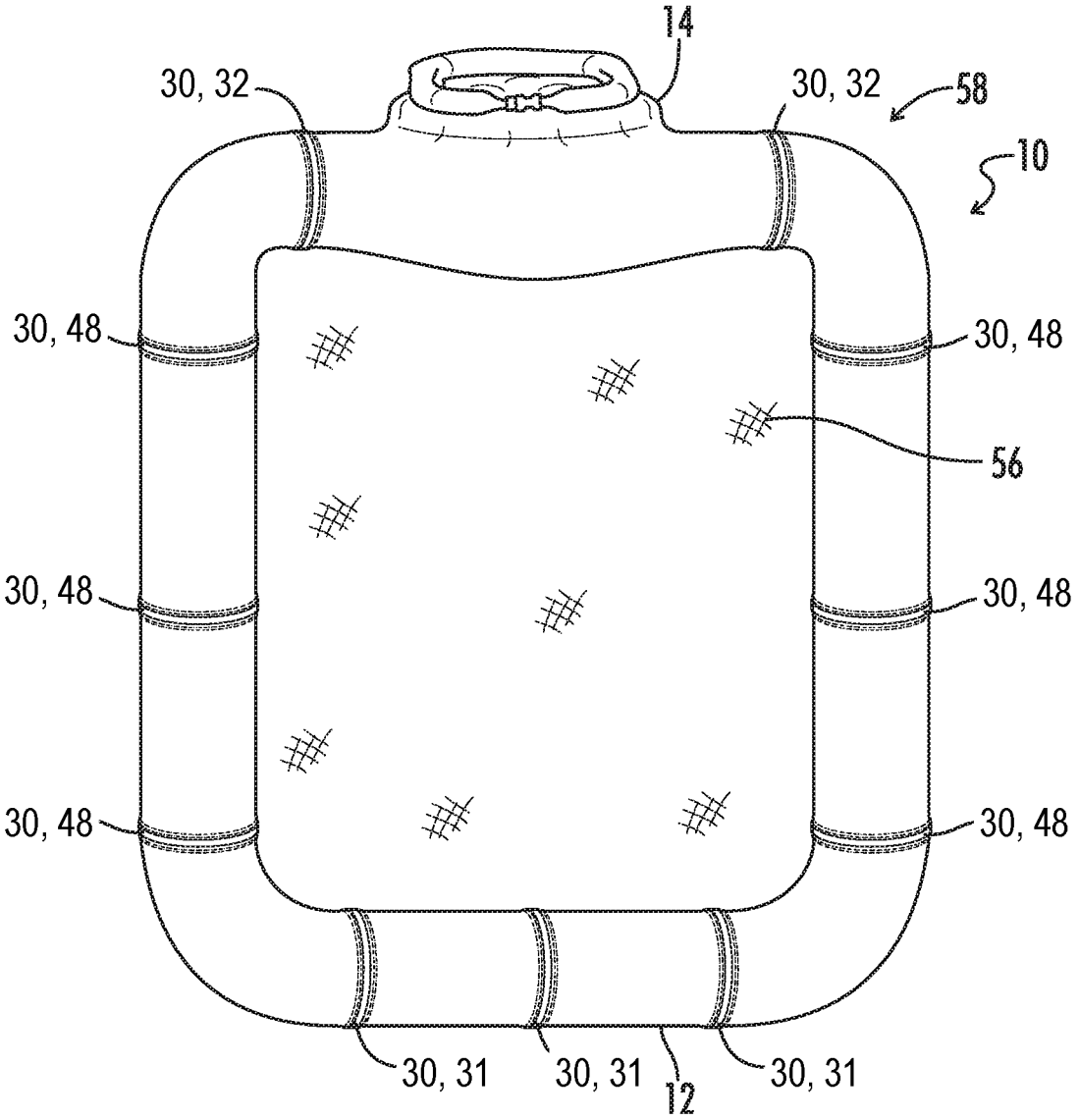
FIG. 8 illustrates a perspective view of a pool float in accordance with another embodiment of the present disclosure, including an inflatable device similar to the inflatable device shown in FIG. 1A but which extends along a rectangular path and which defines an rider support area having a mesh bridge, wherein the body is in the expanded state.

FIG. 8 illustrates that the ribs 31, 32 and 48 may be oriented a number of different ways and that the inflatable device 10 may include a number of ribs 31, 32 and 48. In the embodiment shown in FIG. 8, the air flow path 29 extends in a loop such that the body 11 includes an enclosed aperture 61 and the inflatable device includes a support sheet 62 in the enclosed aperture 61 and connected at multiple points about the periphery of the support sheet 62 to the exterior of the body 11. The support sheet 62 formed from a mesh.

Figure 1B:
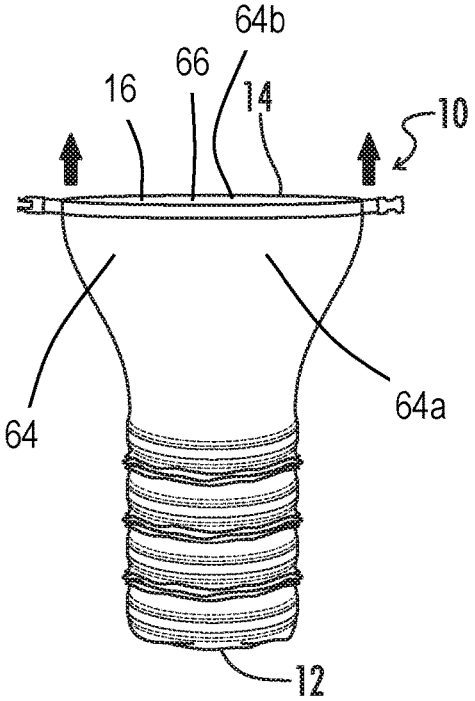
FIG. 1B illustrates a perspective view of the inflatable device of FIG. 1A moving proximally to allow air to enter the interior volume, while the body is in a partially expanded state compared to FIG. 1A.
Figure 1C:
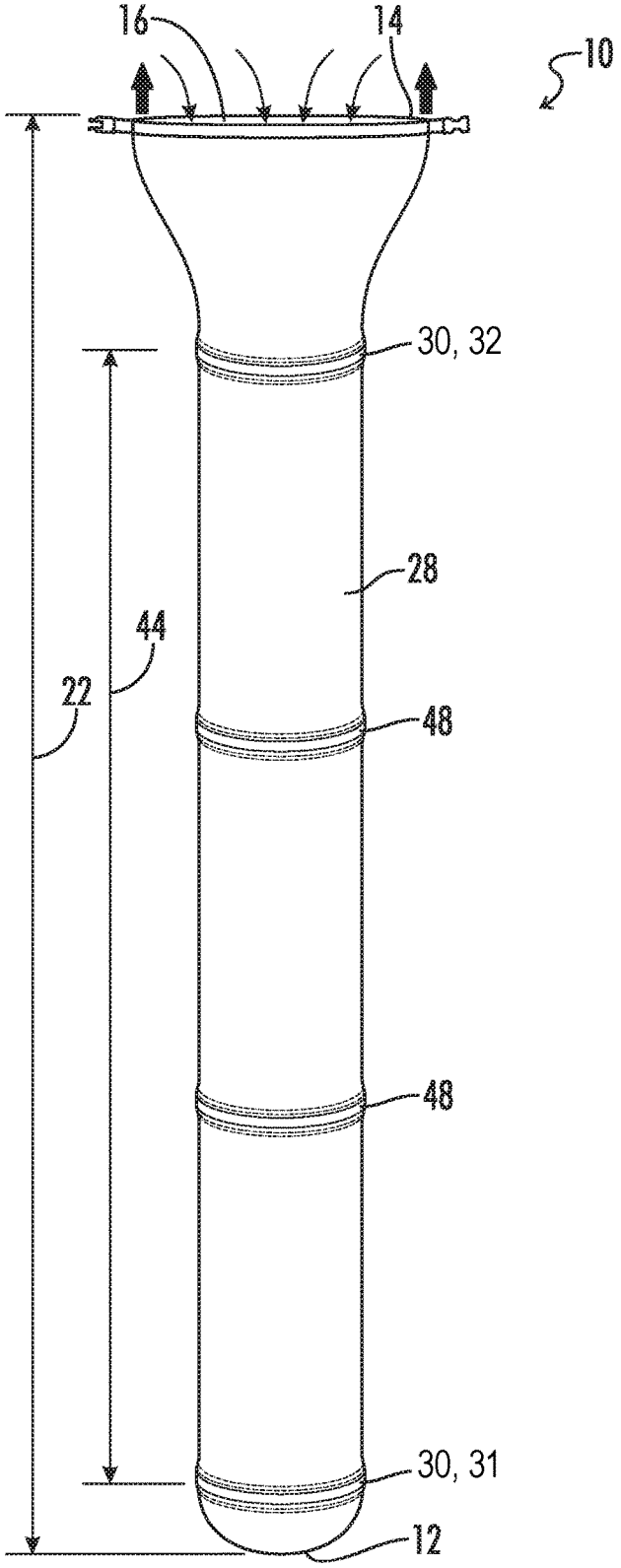
FIG. 1C illustrates a perspective view of the inflatable device of FIG. 1A in an expanded state.
Figure 2:
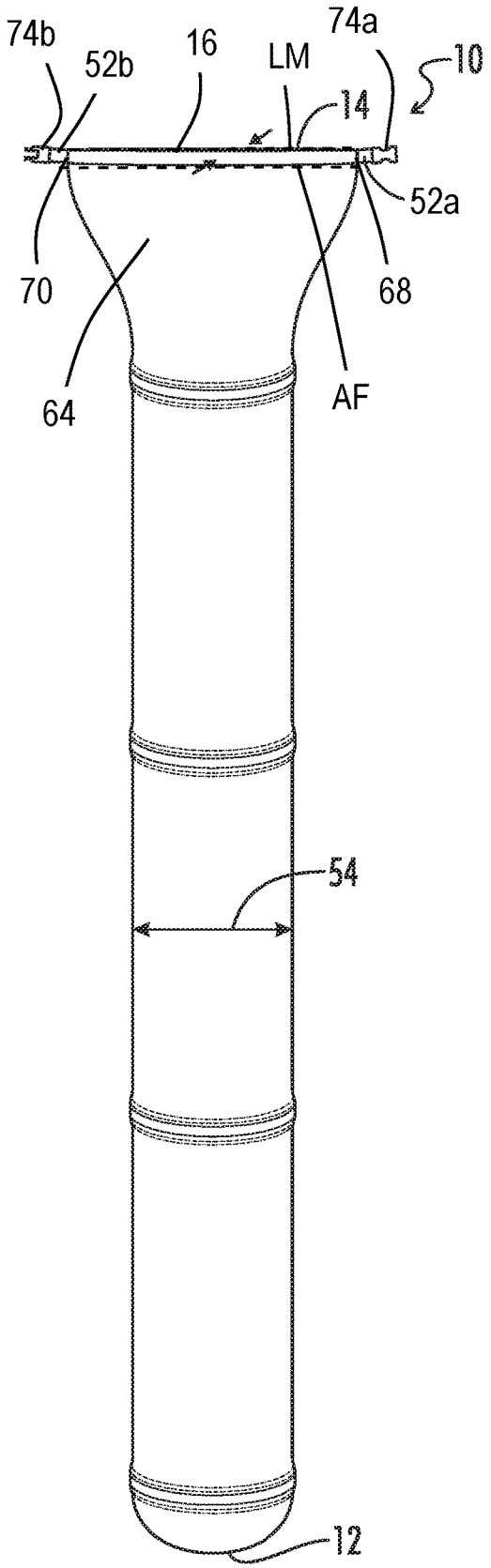
FIG. 2 illustrates a perspective view of the inflatable device of FIG. 1A with the mouth in the closed position, while the body is in the expanded state.
Figure 4:
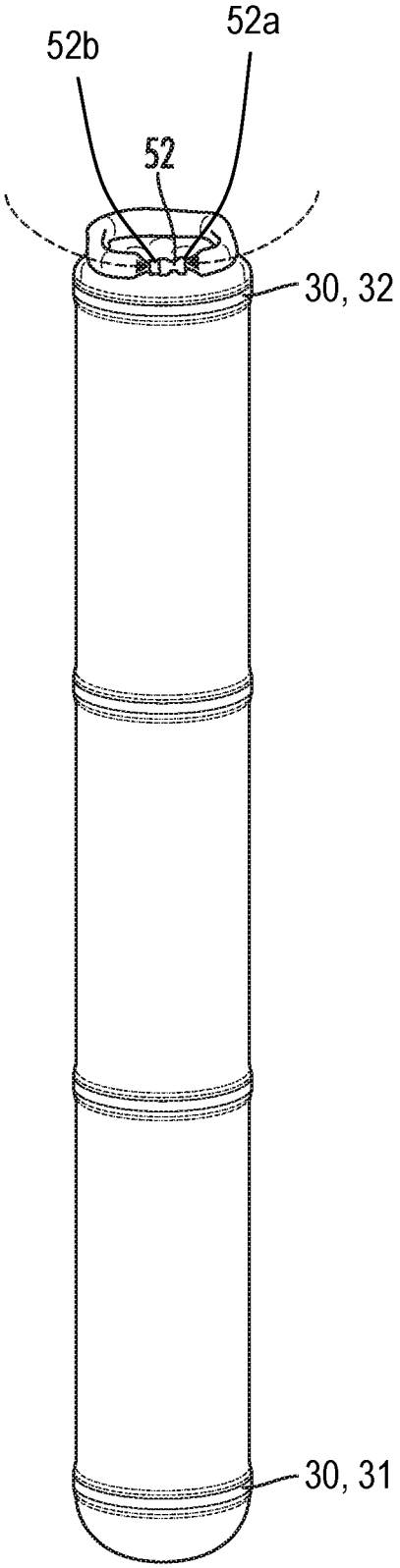
FIG. 4 illustrates a perspective view of the inflatable device of FIG. 1A after the user has secured the rolled up inflatable with the strap thereby putting the mouth in a sealed position, while the body is in the expanded state.
Figure 5:
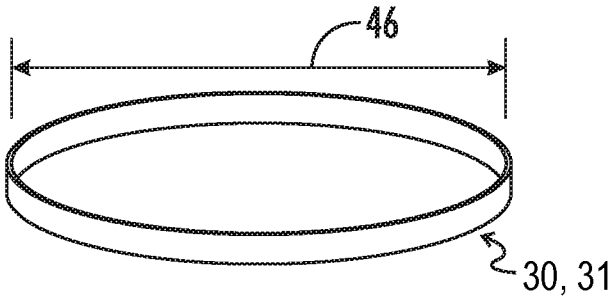
FIG. 5 illustrates a perspective view of a rib (in the form of a ring) for use in an interior volume of the inflatable device shown in FIG. 1A.
Figure 6:
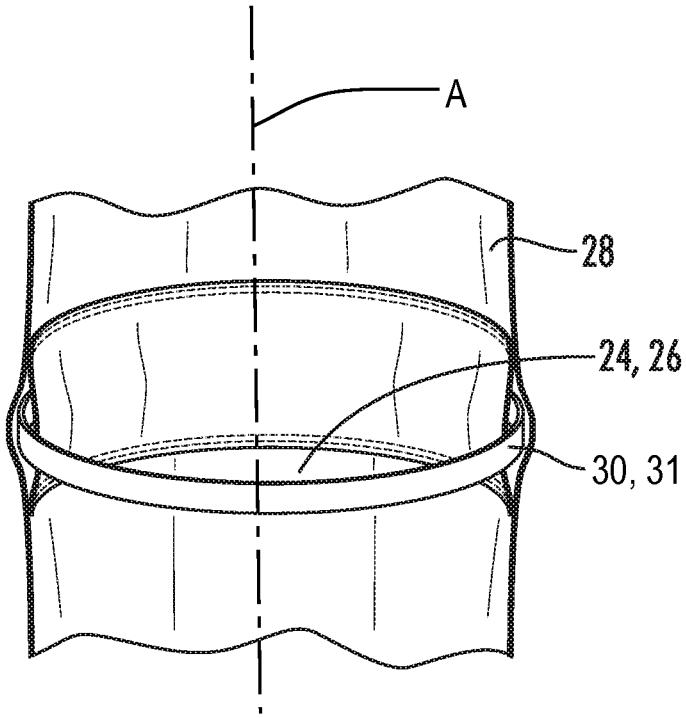
FIG. 6 illustrates a sectional view of the ring of FIG. 5 attached to the wall of the body of the inflatable device shown in FIG. 1A.

The inflatable device 10 may be inflated by any suitable method. For example, the method may include: a) providing the inflatable device 10 wherein the inflatable device 10 is in the collapsed state 34 and the mouth 16 is in the open position 18, as shown in FIG. 1A; b) moving air through the mouth 16 and into the interior volume 26 by moving the inflatable device 10 proximally to move the inflatable device 10 into the expanded state 40, as shown in FIGS. 1B and 1C; c) rolling the proximal end 14 (e.g., in a distal direction) to move the mouth 16 to the closed position 20, as shown in FIGS. 2 and 3; and optionally d) securing the mouth 16 in the closed position 20 and the inflatable device 10 in the rolled up position using the strap 52, as shown in FIG. 4.

Figure 9:
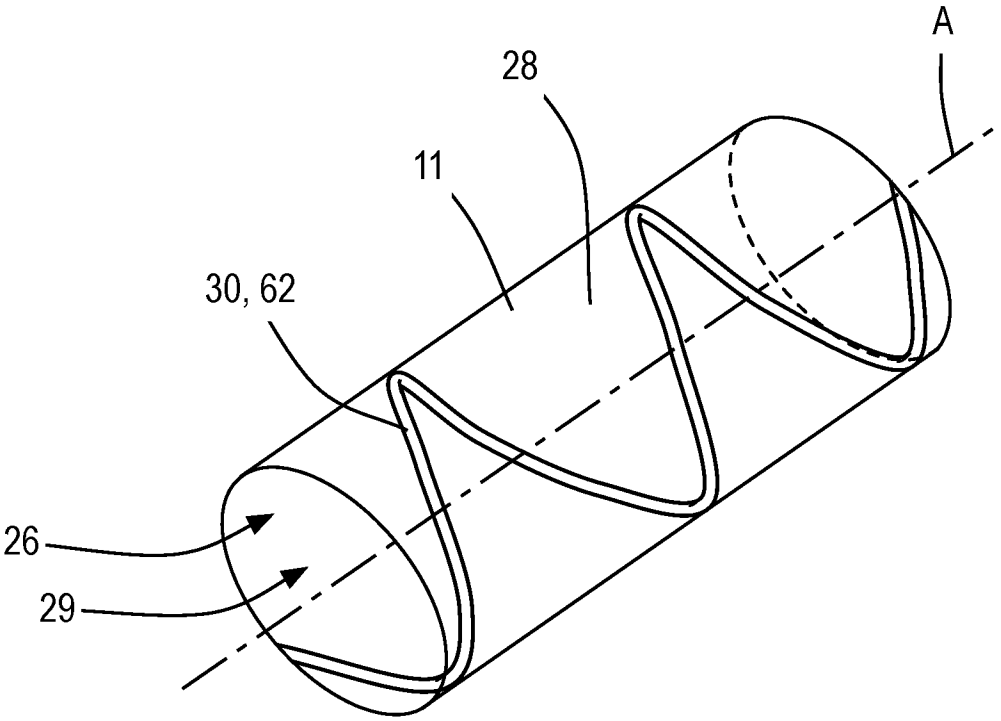
FIG. 9 illustrates a perspective view of a pool float in accordance with another embodiment of the present disclosure, including an inflatable device similar to the inflatable device shown in FIG. 1A but which includes a rib that extends helically to support the body, wherein the body is in the expanded state.

Reference is made to FIG. 9 which shows an alternative embodiment of a structural member for use as part of the inflatable device 10 instead of the rings 31 and 32. In FIG. 9, the at least one structural member 30 is sewn into a pocket in the flexible body wall 28 in similar manner to the ribs 31 and 32, and extends about a periphery of the air flow path 29 and also axially along the air flow path 29. The structural member 30 in FIG. 9 is a single helical member 62 that extends helically about a periphery of the air flow path 29.

Having now described some embodiments in accordance with the requirements of the patent statutes, those skilled in the art will understand how to make changes and modifications to the disclosed embodiments to meet their specific requirements or conditions. Changes and modifications may be made without departing from the scope and spirit of the invention. In addition, the steps of any method described herein may be performed in any suitable order and steps may be performed simultaneously if needed.

Terms of degree such as "generally", "substantially", "about" and "approximately" as used herein mean a reasonable amount of deviation of the modified term such that the end result is not significantly changed. For example, these terms can be construed as including a deviation of at least ±5% of the modified term if this deviation would not negate the meaning of the word it modifies.

Persons skilled in the art will appreciate that there are yet more alternative implementations and modifications possible, and that the above examples are only illustrations of one or more implementations. The scope, therefore, is only to be limited by the claims appended hereto and any amendments made thereto.

LIST OF REFERENCE NUMERALS

| Element in Drawings | Reference Number |
|---|---|
| Inflatable | 10 |
| Body | 11 |
| Sealed Distal End | 12 |
| Proximal End | 14 |
| Mouth | 16 |
| Inflatable Length | 22 |
| Interior volume | 26 |
| Inflatable Flexible Wall | 28 |
| Air flow path | 29 |
| Structural member | 30 |
| Structural Distal rib/ring | 31 |
| Structural Proximal rib/ring | 32 |
| First Distance Proximal | 38 |
| Second Distance Proximal | 44 |
| rib/rings Diameter | 46 |
| Structural Middle rib/ring | 48 |
| Strap | 52 |
| First strap portion | 52a |
| Second strap portion | 52b |
| Strap fastener | 53 |
| Inflatable Diameter | 54 |
| Support sheet | 56 |
| Pool Float | 58 |
| Hammock | 60 |
| Support sheet | 62 |
| Flexible mouth wall | 64 |
| First portion of flexible mouth wall | 64a |
| Second portion of flexible mouth wall | 64b |
| Mouth opening | 66 |
| First end of mouth opening | 68 |
| Second end of mouth opening | 70 |
| Strap fastener | 72 |
| First strap fastener segment | 72a |
| Second strap fastener segment | 72b |
| Air flow path axis | A |
| Air flow path cross-sectional area | ACS |

What is claimed is:

1. An inflatable device, comprising:

a body and a mouth, wherein the mouth is positionable in an open position and a sealed position, wherein the body includes a flexible body wall that defines an interior volume, the body defining at least one air flow path from the mouth through the interior volume, the air flow path having an air flow path axis and having a cross-sectional area, the body further including at least one structural member that applies a force on the flexible body wall transversely outward from the axis so as to urge the flexible body wall towards a transversely expanded state, wherein the body is movable between an axially collapsed state and an axially open state along at least a portion of the air flow path and is urged towards the axially expanded state by a force applied by at least one of: the at least one structural member, and air flow into the body through the mouth when the mouth is held in the open position, wherein the air flow path extends in a loop such that the body includes an enclosed aperture and wherein the inflatable device includes a support sheet in the enclosed aperture.

2. An inflatable device as claimed in claim 1, wherein the at least one structural member includes a plurality of rings that are axially spaced from one another along the air flow path.

3. An inflatable device as claimed in claim 1, wherein the at least one structural member extends about a periphery of the air flow path and also axially along the air flow path.

4. An inflatable device as claimed in claim 3, wherein the at least one structural member is a single helical member that extends helically about a periphery of the air flow.

5. An inflatable device as claimed in claim 1, wherein the body is generally tubular and has a first end that is closed, and a second end that contains the mouth.

6. An inflatable device as claimed in claim 1, wherein the mouth includes a flexible mouth wall that ends at a mouth opening, wherein the mouth opening is movable to a closed position so as to bring the mouth to a closed position, by bringing a first portion of the flexible mouth wall into engagement with a second portion of the flexible mouth wall such that the mouth opening is shaped to have a first end and a second end, wherein the mouth includes a strap fastener formed from a first strap fastener portion on a first strap segment extending from the first end of the mouth opening and a second strap fastener portion on a second strap segment extending from the second end of the mouth opening, wherein the first and second portions of the flexible mouth wall are foldable together iteratively a plurality of times about an axis that is parallel to a line extending from the first end of the mouth opening to the second end of the mouth opening, to bring the mouth to a folded state, wherein, in the folded state, the first and second strap fastener portions are connectable to close the strap fastener and thereby hold the mouth in the folded state, which seals the mouth opening against air leakage out therefrom.

7. An inflatable device as claimed in claim 6, wherein first and second strap fastener portions are first and second clip portions that clip together.

8. An inflatable device as claimed in claim 1, wherein the body is generally cylindrical when in the axially expanded state.

9. An inflatable device, comprising:

a mouth having an open position and a sealed position;

a body having a distal end that is closed, and a proximal end, wherein the body defines an interior volume in gaseous communication with the mouth when the mouth is in the open position, wherein the body has a flexible body wall extending from the distal end to the proximal end, wherein the flexible body wall is air impermeable;

a structural distal ring that is more rigid than the flexible body wall and which is connected to the flexible body wall and which is positioned between the proximal end and the sealed distal end; and a structural proximal ring that is more rigid than the flexible body wall and which is connected to the flexible body wall and which is positioned between the proximal end and the sealed distal end, and is proximal relative to the structural distal ring, wherein the body is collapsible to a collapsed state in which the body has a collapsed length and in which the structural proximal ring is located a first distance from the structural distal ring;

wherein the body is inflatable to an expanded state in which the body has an expanded length and in which the structural proximal ring is located a second distance from the structural distal ring, wherein the expanded length is greater than the collapsed length, and the second distance is greater than the first distance; and wherein the interior volume is sealed when the mouth is in the sealed position, wherein the proximal end further comprises a strap fastener adjacent to the mouth, wherein the strap fastener is configured to secure the mouth in the sealed position.

10. An inflatable device as claimed in claim 9, wherein the structural proximal ring is generally parallel to the structural distal ring.

11. An inflatable device as claimed in claim 9, wherein the structural distal ring and the structural proximal ring are located in the interior volume.

12. An inflatable device as claimed in claim 9, wherein the mouth is adjacent to the proximal end.

13. An inflatable device as claimed in claim 9, wherein the body is generally tubular in shape when the body is in the expanded state.

14. An inflatable device as claimed in claim 9, wherein the body is generally cylindrical in shape when the body is in the expanded state.

15. An inflatable device as claimed in claim 9, wherein, when the body is in the expanded state, the structural distal ring and the structural proximal ring each extend planarly generally perpendicular to the expanded length of the body.

16. An inflatable device as claimed in claim 9, further comprising a structural middle ring located between the structural proximal ring and the structural distal ring and attached to the flexible body wall.

17. An inflatable device as claimed in claim 9, wherein the mouth includes a flexible mouth wall that ends at a mouth opening, wherein the mouth opening is movable to a closed position so as to bring the mouth to a closed position, by bringing a first portion of the flexible mouth wall into engagement with a second portion of the flexible mouth wall such that the mouth opening is shaped to have a first end and a second end, wherein the strap fastener is formed from a first strap fastener portion on a first strap segment extending from the first end of the mouth opening and a second strap fastener portion on a second strap segment extending from the second end of the mouth opening, wherein the first and second portions of the flexible mouth wall are foldable together iteratively a plurality of times about an axis that is parallel to a line extending from the first end of the mouth opening to the second end of the mouth opening, to bring the mouth to a folded state, wherein, in the folded state, the first and second strap fastener portions are connectable to close the strap fastener and thereby hold the mouth in the folded state, which seals the mouth opening against air leakage out therefrom.

18. An inflatable device, comprising:

a mouth having an open position and a sealed position;

a body having a distal end that is closed, and a proximal end, wherein the body defines an interior volume in gaseous communication with the mouth when the mouth is in the open position, wherein the body has a flexible body wall extending from the distal end to the proximal end, wherein the flexible body wall is air impermeable;

a structural distal ring that is more rigid than the flexible body wall and which is connected to the flexible body wall and which is positioned between the proximal end and the sealed distal end; and a structural proximal ring that is more rigid than the flexible body wall and which is connected to the flexible body wall and which is positioned between the proximal end and the sealed distal end, and is proximal relative to the structural distal ring, wherein the body is collapsible to a collapsed state in which the body has a collapsed length and in which the structural proximal ring is located a first distance from the structural distal ring;

wherein the body is inflatable to an expanded state in which the body has an expanded length and in which the structural proximal ring is located a second distance from the structural distal ring, wherein the expanded length is greater than the collapsed length, and the second distance is greater than the first distance; and wherein the interior volume is sealed when the mouth is in the sealed position, a structural middle ring located between the structural proximal ring and the structural distal ring and attached to the flexible body wall.

* * * * *